US008651835B2

(12) United States Patent
Kim

(10) Patent No.: US 8,651,835 B2
(45) Date of Patent: Feb. 18, 2014

(54) MAGNETIC FLUID PUMP WITH HOUSING AND BEARING ARRANGEMENT

(75) Inventor: Byoung Soo Kim, Anyang-si (KR)

(73) Assignee: Amotech Co., Ltd. (KR)

( * ) Notice: Subject to any disclaimer, the term of this patent is extended or adjusted under 35 U.S.C. 154(b) by 0 days.

(21) Appl. No.: 13/697,812

(22) PCT Filed: May 16, 2011

(86) PCT No.: PCT/KR2011/003574

§ 371 (c)(1),
(2), (4) Date: Nov. 14, 2012

(87) PCT Pub. No.: WO2011/145842

PCT Pub. Date: Nov. 24, 2011

(65) Prior Publication Data

US 2013/0058812 A1 Mar. 7, 2013

(30) Foreign Application Priority Data

May 19, 2010 (KR) ..... 10-2010-0046712

(51) Int. Cl.

| | |
|---|---|
| ***F04D 29/04*** | (2006.01) |
| ***F04D 29/046*** | (2006.01) |
| ***F04D 29/18*** | (2006.01) |
| ***F04D 29/40*** | (2006.01) |

(52) U.S. Cl.

USPC ..... 417/420; 417/423.7; 417/423.12; 417/423.14; 417/424.2

(58) Field of Classification Search

USPC ..... 417/420, 423.7, 423.12, 423.14, 424.1, 417/424.2; 310/46

See application file for complete search history.

(56) References Cited

U.S. PATENT DOCUMENTS

| | | | | |
|---|---|---|---|---|
| 3,299,819 | A * | 1/1967 | McCoy | 417/420 |
| 4,277,115 | A | 7/1981 | Stuwe et al. | |
| 4,806,080 | A * | 2/1989 | Mizobuchi et al. | 417/353 |
| 4,990,068 | A * | 2/1991 | Zhong et al. | 417/423.8 |
| 5,314,302 | A * | 5/1994 | Kakizawa et al. | 415/169.1 |

(Continued)

FOREIGN PATENT DOCUMENTS

| | | | | |
|---|---|---|---|---|
| JP | 57108493 | A * | 7/1982 | F04D 13/02 |
| JP | 01125591 | A * | 5/1989 | F04D 13/02 |

(Continued)

OTHER PUBLICATIONS

International Search Report—PCT/KR2011/003574 dated Jan. 17, 2012.

*Primary Examiner* — Devon Kramer
*Assistant Examiner* — Nathan Zollinger
(74) *Attorney, Agent, or Firm* — Cantor Colburn LLP

(57) ABSTRACT

Provided is a fluid pump including: a motor unit that comprises a stator, a rotor, and a rotational shaft on which the rotor is fixed, to thus generate a rotating torque; a pump unit that is placed separately from the motor unit on one side of the motor unit, and that comprises an impeller for pumping fluid: a first power transmission unit that is fixed to the rotor and is rotated with the rotor, and that comprises a first magnet; and a second power transmission unit that is fixed to the impeller and that comprises a second magnet that is disposed facing the first magnet and has opposite polarities to those of the first magnet. Accordingly, fluid can he fundamentally prevented from being introduced into the inside of the motor unit.

8 Claims, 2 Drawing Sheets

(56) References Cited

U.S. PATENT DOCUMENTS

| | | | | |
|---|---|---|---|---|
| 5,316,440 | A * | 5/1994 | Kijima et al. | 415/206 |
| 6,707,206 | B2 * | 3/2004 | Chang | 310/156.08 |
| 2004/0062664 | A1 * | 4/2004 | Weigold et al. | 417/357 |
| 2011/0116921 | A1 * | 5/2011 | Lee et al. | 415/229 |
| 2011/0116953 | A1 * | 5/2011 | Yi et al. | 417/423.7 |
| 2012/0121448 | A1 * | 5/2012 | Kim et al. | 417/423.11 |

FOREIGN PATENT DOCUMENTS

| | | | | |
|---|---|---|---|---|
| JP | 06074184 | | 3/1994 | |
| JP | 06074184 | A * | 3/1994 | F04D 13/02 |
| JP | 2002089491 | | 3/2002 | |
| JP | 2006274915 | | 10/2006 | |
| JP | 2007002781 | | 1/2007 | |

* cited by examiner

MAGNETIC FLUID PUMP WITH HOUSING AND BEARING ARRANGEMENT

TECHNICAL FIELD

The present invention relates to a fluid pump in which an impeller is separated from a motor, so as to prevent fluid from flowing in the motor.

BACKGROUND ART

In general, a water pump motor is used to drive a water pump that is installed in a drain water tank of a washing machine or is used as a driving source of a water pump that is used for circulation of a coolant that cools an engine. A water pump equipped with the water pump motor works under an environment that the inside of the water pump always directly contacts water.

Thus, a motor pump having a mechanical seal structure or a canned motor pump having a canned cover structure for sealing a stator is used for the purpose of protecting a motor from water when the water of the inside of a water pump is drained to the outside of the water pump or in order to prevent failure of bearings or shortened life of belts due to leakage of a coolant.

U.S. Pat. No. 4,277,115 proposed the canned motor pump, in which a canned cover seals only a stator and thus a rotor soaks in water. Accordingly, durability of a bearing to support a rotational shaft is adversely affected. In addition, an optimal magnetic gap cannot be maintained because of a canned cover that is placed between the rotor and the stator, to thereby cause a low efficiency.

In addition, since the rotor soaks in water in the canned motor pump, rotation of the rotor is affected to thus decrease a motor efficiency.

Moreover, since a conventional motor pump has a structure that the axis of rotation of the impeller is integrally formed with the axis of rotation of the motor, a motor assembly and a pump assembly may not be independently assembled and tested, to thus cause a low assembly productivity problem.

In addition, when the canned cover for use in the canned motor pump is molded by using a PPS (PolyPhenylene Sulfide) material and then assembled with a stator, there is a problem that the canned cover is not easily combined with a stator core.

Furthermore, according to the conventional art, the outside of the stator employs a double sealing structure. Here, the outside of the stator is insert-molded by using BMC (Bulk Mould Compound) and is simultaneously sealed by a canned cover using a PPS sealing material, to thus cause a manufacturing cost to increase.

DISCLOSURE

Technical Problem

To solve the above problems or defects, it is an object of the present invention to provide a fluid pump that can improve watertight performance of a motor in which the motor is separated from an impeller and a torque of the motor is transferred to the impeller by using a magnetic force.

It is another object of the present invention to provide a fluid pump that does need a separate watertight treatment by separating a motor from an impeller, and that can improve a motor efficiency by setting an optimal magnetic gap between a rotor and a stator in the motor.

It is still another object of the present invention to provide a fluid pump that can seal a motor without an additional sealing device, to thus reduce a manufacturing cost.

It is yet another object of the present invention to provide a fluid pump in which the hinge axis of an impeller is separated from the axis of rotation of a motor and thus the impeller and the motor are supported in respectively independent internal spaces, to thereby respectively assemble and test a motor assembly and a pump assembly easily and thus enhance an assembly productivity.

Technical Solution

To accomplish the above and other objects of the present invention, according to an aspect of the present invention, there is provided a fluid pump comprising:

a motor unit that comprises a stator, a rotor, and a rotational shaft on which the rotor is fixed, to thus generate a rotating torque;

a pump unit that is placed separately from the motor unit on one side of the motor unit, and that comprises an impeller for pumping fluid;

a first power transmission unit that comprises a first magnet that is fixed to the rotor and is rotated with the rotor; and a second power transmission unit that comprises a second magnet that is fixed to the impeller and is disposed facing the first magnet and that has opposite polarities to those of the first magnet.

Preferably but not necessarily, the motor unit is an inner rotor type.

Preferably but not necessarily, the motor unit comprises:

a first case in which the rotor and the stator are housed and whose top portion is clogged and whose bottom portion is opened;

a second case that seals the opened bottom portion of the first case and that accommodates a driver; and a third case that seals the opened bottom portion of the second case.

Preferably but not necessarily, an upper surface of the first case is positioned between the first magnet and the second magnet, and is formed thinner than the remaining portion of the first case except the upper surface of the first case.

Preferably but not necessarily, an upper end of the rotational shaft is rotatably supported to an upper bearing that is mounted on a first bearing mount unit that is formed in the first case, and a lower end of the rotational shaft is rotatably supported to a lower bearing that is mounted on a second bearing mount unit that is formed in the second case.

Preferably but not necessarily, the upper bearing that is mounted on the first bearing mount unit and the lower bearing that is mounted on the second bearing mount unit are oil filled ball bearings.

Preferably but not necessarily, the rotor comprises:

a back yoke that forms a magnetic circuit and at a central portion of which the rotational shaft is coupled;

a plurality of magnets that are combined on the outer circumference of the back yoke; and a rotor support that extends from the side ends of the back yoke and the magnets.

Preferably but not necessarily, the pump unit comprises a pump housing that houses the impeller and comprises an inlet and an outlet through which fluid flows in and out and whose opened bottom portion is sealably mounted on the first case, a third bearing mount unit that rotatably supports an upper end of a hinge shaft to which the impeller is fixed is formed in the pump housing, and a fourth bearing mount unit that rotatably supports a lower end of the hinge shaft is formed in the first case.

Preferably but not necessarily, the upper bearing that is mounted on the third bearing mount unit and the lower bearing that is mounted on the fourth bearing mount unit are oilless bearings.

Preferably but not necessarily, the first power transmission unit comprises a flange that is fixed to the rotor and is rotated with the rotor and on which the first magnet is fixed, in which the flange is integrally extensively formed in the rotor support.

Preferably but not necessarily, the first power transmission unit and the second power transmission unit further comprise a first back yoke and a second back yoke that mutually connect the first magnet and the second magnet, respectively, to form a magnetic circuit.

According to another aspect of the present invention, there is also provided a fluid pump comprising:

a motor unit having a rotor and a stator to generate a rotating torque;

a first power transmission unit that is integrally formed and rotated with the rotor of the motor unit in which a first magnet is placed;

a first case in which an inner space is formed and that accommodates the motor unit and the first power transmission unit;

a pump housing having an inlet and an outlet through which fluid flows in and out and whose opened lower end is sealably mounted on the first case and that forms a fluid flow path therein together with the first case;

a second power transmission unit that is disposed in the inside of the fluid flow path and generates a magnetic force together with the first power transmission unit to thus be rotated according to rotation of the first power transmission unit; and an impeller that is integrally formed in the second power transmission unit to thus pump fluid.

Advantageous Effects

As described above, a fluid pump according to the present invention includes a motor unit that generates a rotating torque if electric power is applied to the motor unit, a pump unit that pumps fluid, and power transmission units that are placed between the motor unit and the pump unit to generate a magnetic force, to thereby fundamentally block water from being introduced into the motor unit.

In addition, in the case of the fluid pump according to the present invention, the pump unit having an impeller is mutually isolated from the motor unit having a rotor and a stator, to thus fundamentally block water from being introduced into the motor unit. Accordingly, the fluid pump according to the present invention does not need an additional watertight device. In addition, a magnetic gap between the rotor and the stator in the motor unit is set in an optimal state, to thus enhance efficiency of the motor unit.

In addition, the fluid pump according to the present invention can block water from being introduced into the inside of the motor unit, to thereby support a rotational shaft of the motor unit with an oil-filled ball bearing, and to thus improve durability as well as achieve cost savings.

BEST MODE

Hereinafter, a fluid pump according to a preferred embodiment of the present invention will be described in detail with reference to the accompanying FIGS. 1 and 2.

Figure 1:
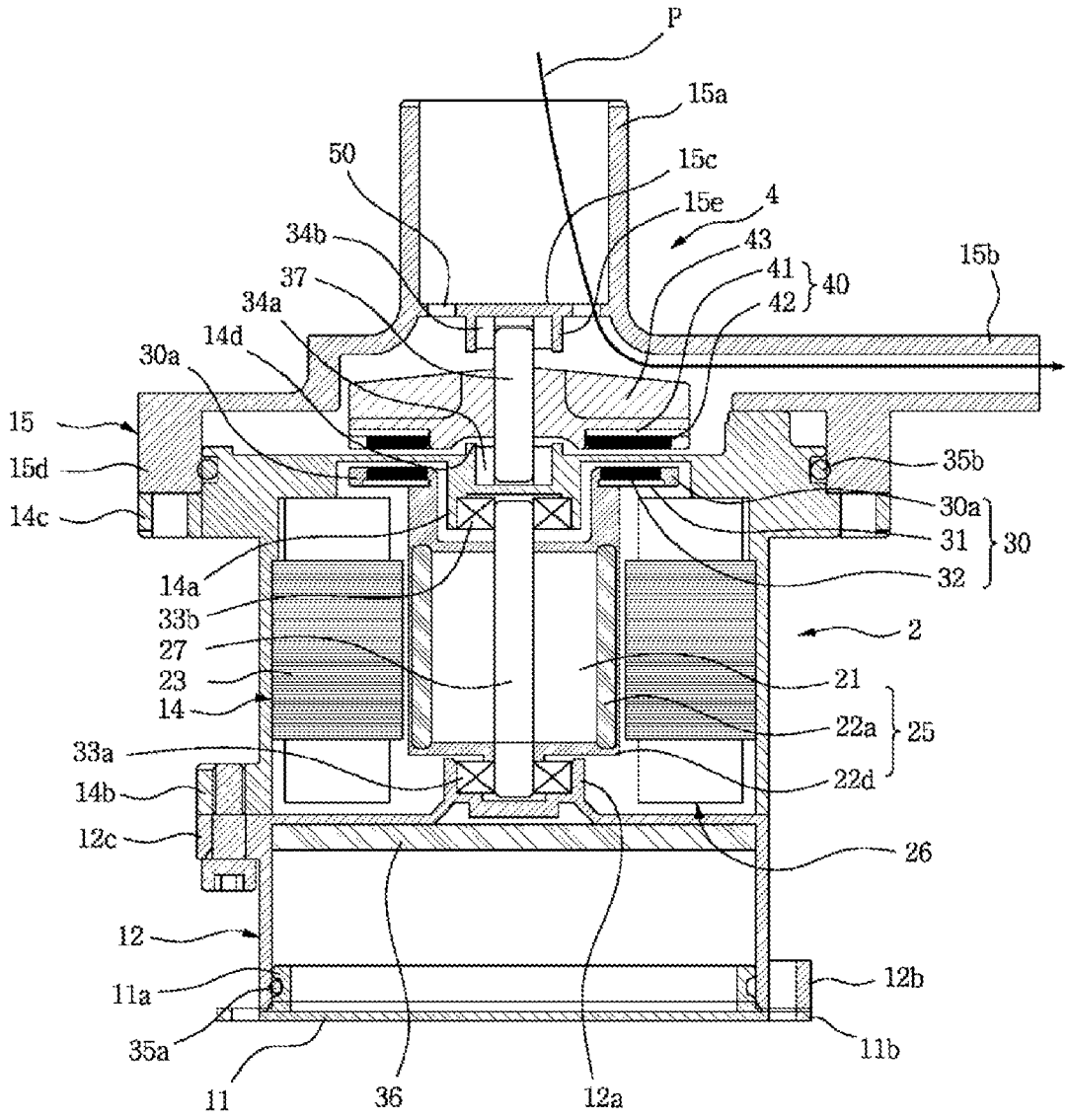
FIG. 1 is a cross-sectional view illustrating a fluid pump according to an embodiment of the present invention.
Figure 2:
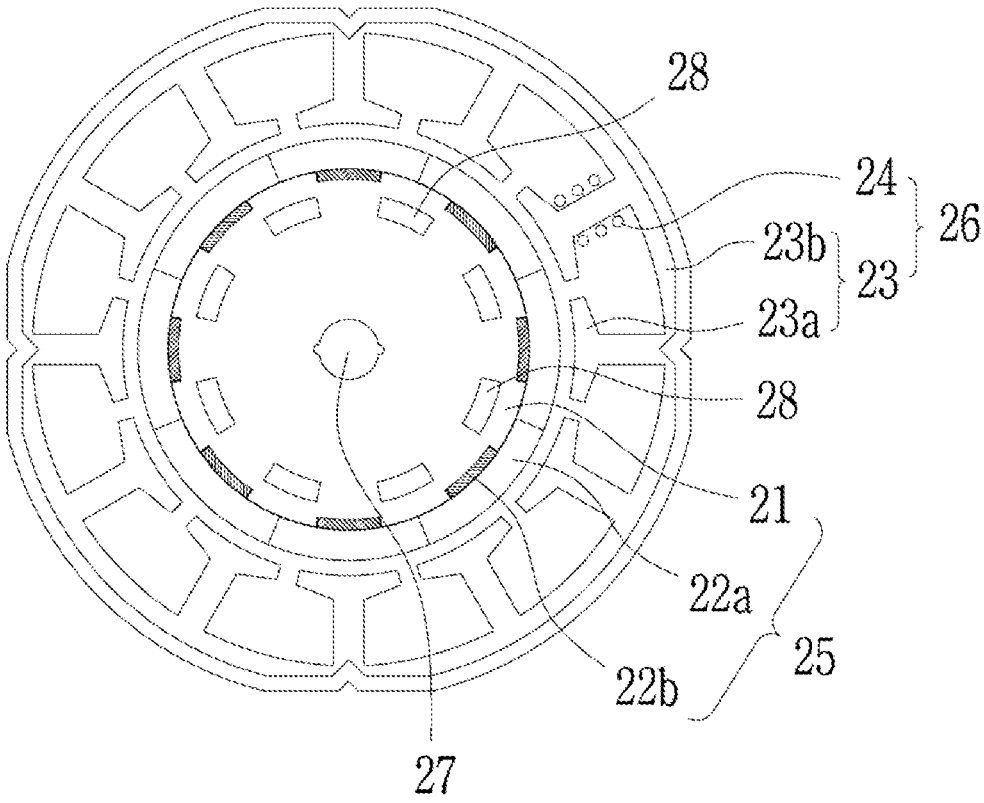
FIG. 2 is a schematic cross-sectional view illustrating an example of an electric motor employed in the fluid pump of FIG. 1.

Referring to FIGS. 1 and 2, a fluid pump according to an embodiment of the present invention, includes a motor unit 2 that generates a rotating torque if electric power is applied to the motor unit 2, a pump unit 4 that is separated from the motor unit 2, to pump fluid, and power transmission units 30 and 40 that transmit the rotating torque of the motor unit 2 to the pump unit 4.

The motor unit 2 includes: a first case 14 whose top portion is clogged and whose bottom portion is opened: a stator 26 that is fixed to the inner surface of the first case 14; a rotor 25 that is disposed with a certain gap from the inner surface of the stator 26 and that interacts with the stator 26 to then be rotated; and a rotational shaft 27 that is fixed to the inner surface of the rotor 25, and is rotated, with the rotor 25.

A second case 12 whose top portion is clogged and whose bottom portion is opened is fixed to the opened bottom of the first case 14, and a third case 11 that seals the inside of the second case 12 is fixed to the opened bottom of the second case 12.

A cylindrical protrusion 11*a* is formed in the third case 11 and inserted into the inner surface of the bottom of the second case 12. A sealing O-ring 35*a* is inserted into the protrusion 11*a*, to thus seal between the second case 12 and the third case 11.

At least three bolt fixing units 11*b* and 12*b* are protruded between the third case 11 and the second case 12, in which fixing screws or fixing bolts are combined into fixing holes. At least three bolt fixing units 12*c* and 14*b* are protruded between the second case 12 and the first case 14. in which fixing screws or fixing bolts are combined into fixing holes.

The motor unit 2 is an inner rotor type, in which the rotor 25 is disposed on the inner circumferential surface of the stator 26.

An upper end of the rotational shaft 27 is rotatably supported on the inner surface of the first case 14, and a lower end of the rotational shaft 27 is rotatably supported on the outer surface of the second case 12.

A first bearing mount unit 14*a* on which an upper bearing 33*b* that rotatably supports the upper end of the rotational shaft 27 is formed in the first case 14, and a second bearing mount unit 12*a* on which a lower bearing 33*a* that rotatably supports the lower end of the rotational shaft 27 is formed in the second case 12.

Here, the upper bearing 33*b* and the lower bearing 33*a* are inherently separated from the motor unit 2 and the pump unit. 4, to thereby prevent water from flowing into the inside of the motor unit 2. Accordingly, it is possible to use oil-filled ball bearings having no watertight function as the upper bearing 33*b* and the lower bearing 33*a*. Thus, when compared with oilless bearings, durability can be heightened and manufacturing costs can be reduced. It is of course possible to use oilless bearings as the upper bearing 33*b* and the lower-bearing 33*a*.

As shown in FIG. 2, the rotor 25 includes: a back yoke 21 at a central portion of which the rotational shaft 27 is coupled; and isotropic magnets 22*a* that are disposed at regular intervals on the outer circumference of the back yoke 21.

In other words, the rotor 25 includes: the back yoke 21 (that is, a rotor core) that is formed of laminated magnetic steel sheets and at a central portion of which a throughhole is formed in which the rotational shaft 27 is coupled through the throughhole; and the ring-shaped isotropic magnets 22*a* that are combined on the outer circumference of the back yoke 21. Divisionally magnetization processed magnets to form N-pole magnets and S-pole magnets alternately are used as the ring-shaped isotropic magnets 22*a*.

It is desirable to integrally form a rotor support 22*d* on the upper and lower surfaces and the outer circumferential surface of the back yoke 21 and isotropic magnets 22*a* of the rotor 25 in an insert molding method by using resin in the rotor 25 in terms of a sealing effect.

The rotor support 22*d* is effective to seal magnets located in the inside of the rotor 25 when a fluid pump is used as a water pump in a humid environment.

In addition, a number of recesses are formed at every predeterminedly set angle on the outer circumferential surface of the back yoke 21 in the rotor 25. Accordingly, it is also possible to insert a number of segment-shaped burial-type anisotropic auxiliary magnets 22*b* into the recesses.

In this case, it is desirable that the burial-type anisotropic auxiliary magnets 22*b* are made of ferromagnetic magnets, for example, a hard ferrite material made of a $SmCo_5$ group, $Sm_2Co_{17}$ group, $Nd_2Fe_{14}B$ group, or $Sm_2Fe_{17}N_3$ group rare-earth alloy. In particular, it is desirable that an Nd-based alloy having a big energy product (BHmax) is, for example, Nd—Fe—B (anisotropic magnet).

Moreover, the ring-shaped isotropic magnets 22*a* that are made of, for example, a ferrite-based material that is available at a low price, are combined on the outer periphery of the back yoke 21.

The burial-type anisotropic auxiliary magnets 22*b* are magnetized in a radial direction of the rotor 25 to thus form an anode. Accordingly, a rotating torque is generated by interaction between a magnetic flux formed by the anisotropic auxiliary magnets 22*b* and a rotating magnetic field formed by electric current flowing in coils 24 of the stator 26.

Meanwhile, a number of leakage preventive holes, i.e., spacers 28 are circularly disposed along an inner side in the circumferential direction of the burial-type anisotropic auxiliary magnets 22*b*, and are formed at regular intervals with a length corresponding to each length of the anisotropic auxiliary magnets 22*b* between the respective two adjacent anisotropic auxiliary magnets 22*b*. The spacers 28 may increase self-resistance to thereby prevent the magnetic flux leakage. As a result, the burial-type anisotropic auxiliary magnets 22*b* form a magnetic circuit from the N-pole to the S-pole in the lateral direction (i.e., the circumferential direction), respectively.

As a result, the rotor 25 of the present invention having the above-mentioned structure has a hybrid magnet structure having an overall 8-pole magnetic pole by a mutual combination of the eight burial-type anisotropic auxiliary magnets 22*b* and the ring-shaped isotropic magnets 22*a* that are magnetized into eight poles. The hybrid magnet structure can entirely maintain a magnetic force not less than those of the anisotropic auxiliary magnets 22*b*, due to the anisotropically oriented burial-type anisotropic auxiliary magnets 22*b*.

The stator 26 has a structure that a bobbin is combined with an integral stator core 23 having a number of T-shaped protruding teeth 23*a* on the inner circumference of a cylinder-shaped body 23*b* formed by stacking a number of magnetic steel plates, and a coil 24 is wound on the bobbin.

In addition, the stator 26 may be implemented in an annular form by insert-molding the outer circumference of the stator core 23 using a bulk mould compound (BMC) in order to reinforce a sealing performance after the coil 24 has been wound on the bobbin formed in the outer portion of the stator core 23.

Moreover, the stator 26 may employ an integral type structure that a coil is wound on a number of divided cores to then be integrated by a stator support, other than the integral type stator core 23.

The stator 26 receives a drive signal for the stator coil 24 from a driver 36 that is housed in the second case 12.

The pump unit 4 includes: a pump housing 15 that is coupled on top of the first case 14; and an impeller 43 that is rotatably disposed in the inside of the pump housing 15, to pump fluid.

An inlet 15*a* through which fluid flows into the inside of the pump housing 15 is formed at the center of the upper portion of the pump housing 15, and an outlet 15*b* through which the pumped fluid is discharged is formed on the side of the pump housing 15. The bottom of the pump housing 15 is formed in an opened state and is sealably fixed on top of the first case 14.

At least three bolt joints 14*c* and 15*d* are protruded for mutual coupling between the pump housing 15 and the first case 14, in which fixing screws or fixing bolts are combined with fastening holes, respectively. In addition, a sealing O-ring 35*b* is inserted between the outer circumferential surface of the first case 14 and the inner circumferential surface of the pump housing 15, to thus seal between the first case 14 and the pump housing 15.

The impeller 43 is placed along a fluid flow passage P that is formed in the inside of the pump housing 15, to thus play a role of pumping fluid, flowing in through the inlet 15*a* and discharging the pumped fluid through the outlet 15*b*, and is formed to have a number of wings that are radially formed on top of a circular plate shaped body of the impeller 43.

A hinge shaft 37 is fixed to the impeller 43. the upper end of the hinge shaft 37 is rotatably supported in the pump housing 15, and the lower end of the hinge shaft 37 is rotatably supported on the upper surface of the first case 14.

In other words, a support plate 15*c* is formed at the inlet 15*a* of the pump housing 15, in which a number of throughholes 50 are penetratively formed in the support plate 15*c* so that fluid passes through the throughholes 50. A third, bearing mount unit 15*e* is formed on the support plate 15*c*. in which an upper bearing 34*b* that rotatably supports the upper end of the hinge shaft 37 is mounted on the third bearing mount unit 15*e*. A fourth bearing mount unit 14*d* is formed, on the upper surface of the first case 14, in which a lower bearing 34*a* that rotatably supports the lower end of the hinge shaft 37 is mounted on the fourth bearing mount unit 14*d*.

It is desirable that oilless bearings such as carbon bearings and plastic bearings are used as the upper bearing 34*b* and the lower bearing 34*a* when considering that those bearings are in contact with fluid.

The power transmission units 30 and 40 includes: a first power transmission unit 30 that includes a first magnet 32 that is fixed to the rotor 25 and is rotated, with the rotor 25; and a second power transmission unit 40 that includes a second magnet 42 that is disposed facing the first magnet 32 and has opposite polarities to those of the first magnet 32 to generate an attraction force by interacting with the first magnet 32 and that is fixed to the impeller 43.

The first power transmission unit 30 includes: the first magnet 32; a flange 30*a* that includes a recess that is formed at an end portion that is extended from the rotor support 22*d* in which the first magnet 32 is fixed, into the recess: and a back yoke 31 that is mounted in the inner side of the recess to thus form a magnetic circuit.

Here, the first magnet 32 may be implemented into a number of split magnet pieces that are alternately arranged in an N-pole and an S-pole, or a ring-shaped magnet that is divisionally magnetized into an N-pole and an S-pole.

The flange 30*a* has a structure that is integrally formed in the rotor support 22*d*, but may also have a structure that is fixed on the rotational shaft 27.

The second power transmission unit 40 includes: the second magnet 42 that is inserted into the recess formed in the lower surface of the impeller 43 and is disposed to face the first magnet 32 each other; and a back yoke 41 that is fixed on the inner surface of the recess to thus form a magnetic circuit.

The second magnet 42 has an opposite polarity to that of the first magnet 32, and may be implemented into a number of split magnet pieces that are alternately arranged in an N-pole and an S-pole, or a ring-shaped magnet that is divisionally magnetized into an N-pole and an S-pole.

It is preferable that the upper surface of the first case 14 disposed between the first power transmission unit 30 and the second power transmission unit 40 is thinly formed when compared to other parts, in a manner that a magnetic force formed between the first magnet 32 and the second magnet 42 smoothly works through the upper surface of the first case 14.

The first magnet 32 and the second magnet 42 are formed as the split magnet pieces or the divisionally magnetized magnets that are disposed to have the opposite magnetic polarities to each other at portions facing each other so that the rotational movement of the first magnet 32 may be transferred to the second magnet 42 to thereby generate an attraction force by the interaction between the first magnet 32 and the second magnet 42.

A function of the fluid pump that is implemented as mentioned above according to the embodiment of the present invention will follow.

When power is applied to the stator 26 of the motor unit 2, the rotor is rotated by the interaction between the stator 26 and the rotor 25, and thus the first power transmission unit 30 is fixed to the rotor 25 is rotated.

Then, the second magnet 42 is rotated together with the first magnet 32 according to an attraction force by the interaction between the first magnet 32 and the second magnet 42 that is disposed facing the first magnet 32 of the first power transmission unit 30.

Accordingly, the impeller 43 to which the second power transmission unit 40 is fixed is rotated around the hinge shaft 37, to thus pump fluid flowing in through the inlet 15*a* and discharge the pumped fluid through the outlet 15*b*.

As described above, since the pump unit 4 that pumps fluid is mechanically separated from the motor unit 2 that generates a rotating torque that drives the pump unit 4 in the fluid pump according to the embodiment of the present invention, fluid such as water can be fundamentally prevented from flowing into the motor unit 2.

Moreover, in the case of the fluid pump according to the embodiment of the present invention, the motor unit 2 and the pump unit 4 are mutually isolated from each other, and the power transmission units 30 and 40 using the magnetic force between the motor unit 2 and the pump unit 4 are provided. Accordingly, the fluid pump according to the present invention does not need an additional sealing component for sealing the motor unit 2. In addition, a magnetic gap between the rotor 25 and the stator 26 in the motor unit 2 is set in an optimal state, to thus enhance efficiency of the motor unit.

In addition, the fluid pump according to the embodiment of the present invention has a watertight structure that water may not be inherently introduced into the inside of the motor unit 2. Accordingly, it is possible to support the rotational shaft 27 of the motor unit 2 with a general bearing that does not employ a watertight bearing, to thereby enhance durability together with cost sayings.

In the above-described embodiment, it has been described that the driver is accommodated in the Inside of the second case. However, it is possible to dispose the driver in the inside of the first case.

In addition, in the above-described embodiment, it has been described that an inner rotor type motor unit 2 is used in which the stator 26 is disposed at the outer side of the motor unit. 2 and the rotor 25 is disposed at the center of the motor unit 2 where a magnetic gap is interposed between the stator 26 and the rotor 25, in order to rotatably drive the power transmission unit 30. However, any type motor that may provide a rotating torque that rotatably drive the power transmission unit 30, for example, an outer rotor type or double rotor type motor may be used as the motor unit that Is applied in the present invention.

In addition, in the above-described embodiment, it has been described that a core type stator is used as the stator that is applied in the present invention. However, it is possible to use a coreless type stator in the present invention.

Moreover, in the above-described embodiment, it has been described that the first power transmission unit 30 and the second power transmission unit 40 have the back yokes 31 and 41 that are respectively disposed on the inner side surfaces of the first magnet 32 and the second magnet 42 that are implemented by using the magnet pieces or divisionally magnetized magnets, in order to form the magnetic circuit. However, it is possible to remove the back yokes 31 and 41, As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

The fluid pump according to the embodiment of the present invention employs a structure that a motor unit that generates a rotating torque and a pump unit that pumps fluid are isolated from each other, and the rotating torque of the motor unit is delivered to the pump unit by using a magnetic force, thereby fundamentally waterproofing the motor unit, and thus may be applied to a fluid pump that needs sealing of a motor as in a water pump or fuel pump.

The invention claimed is:

1. A fluid pump comprising:

a motor unit that comprises a stator, a rotor, and a rotational shaft on which the rotor is fixed, to thus generate a rotating torque;

a pump unit that is placed separately from the motor unit on one side of the motor unit, and that comprises an impeller for pumping fluid;

a first power transmission unit that comprises a first magnet that is fixed to the rotor and is rotated with the rotor;

a first case that houses the motor unit and the first power transmission, wherein the first case is formed of a single monolithic piece and includes a first clogged top portion and a first open bottom portion, and an upper end of the rotational shaft is rotatably supported on an inner surface of the first clogged top portion;

a second power transmission unit that is disposed above the first clogged top portion and comprises a second magnet that is fixed to the impeller, wherein the first magnet and the second magnet are disposed facing each other at both sides of the first clogged top portion and have opposite polarities, and the portion of the first clogged top portion where the first and second magnets face each other has a thickness thinner that the remaining portion of the first clogged top portion;

a second case that houses a driver and is formed of a single monolithic piece having a second clogged top portion and a second open bottom portion, wherein the second clogged top portion is combined with the first open bottom portion of the first case, and a lower end of the rotational shaft is rotatably supported on an outer surface of the second clogged top portion; and a third case that seals the second open bottom portion of the second case.

2. The fluid pump according to claim 1, wherein the motor unit is an inner rotor type.

3. The fluid pump according to claim 1, wherein the first case includes a first bearing mount unit where the upper end of the rotational shaft is supported by an upper bearing, and the second case includes a second bearing mount unit wherein the lower end of the rotational shaft is supported by a lower bearing.

4. The fluid pump according to claim 3, wherein the upper bearing and the lower bearing are oil filled ball bearings.

5. The fluid pump according to claim 1, wherein the rotor comprises:

a back yoke that forms a magnetic circuit and at a central portion of which the rotational shaft is coupled;

a plurality of magnets that are combined on the outer circumference of the back yoke; and a rotor support that extends from one side of the back yoke and the plurality of the magnets.

6. The fluid pump according to claim 1, wherein the pump unit comprises a pump housing that houses the impeller and comprises an inlet and an outlet through which fluid flows in and out and whose opened bottom portion is sealably mounted on the first case, a third bearing mount unit that rotatably supports an upper end of a hinge shall to which the impeller is fixed is formed in the pump housing, and a fourth bearing mount unit that rotatably supports a lower end of the hinge shaft is formed in the first case.

7. The fluid pump according to claim 5, wherein the first power transmission unit comprises a flange that is fixed to the rotor and is rotated with the rotor and on which the first magnet is fixed, and the flange is integrally extensively formed in the rotor support.

8. The fluid pump according to claim 1, wherein the first power transmission unit and the second power transmission unit further comprise a first back yoke and a second back yoke that mutually connect the first magnet and the second magnet, respectively, to form a magnetic circuit.

* * * * *